US005211122A

United States Patent [19]

Lin

[11] Patent Number: 5,211,122

[45] Date of Patent: May 18, 1993

[54] THREAD TENSION DEVICE FOR A SEWING MACHINE

[76] Inventor: Horng-Ji Lin, P.O. Box 63-151, Taichung, Taiwan

[21] Appl. No.: 913,350

[22] Filed: Jul. 15, 1992

[51] Int. Cl.[5] ..... D05B 47/02

[52] U.S. Cl. ..... 112/254; 242/150 R

[58] Field of Search ..... 112/254, 255, 302; 242/149, 150 R

[56] References Cited

U.S. PATENT DOCUMENTS 4,694,765 9/1987 Diehl ..... 112/254

5,156,105 10/1992 Wang ..... 112/254

*Primary Examiner*—Clifford D. Crowder

*Assistant Examiner*—Paul C. Lewis

[57] ABSTRACT

A thread tension device including a plate fixed on a sewing machine, a bolt rotatably engaged in the plate, a pin engaged on the plate, a dial rotatably engaged on the bolt and having a number of holes for engagement with the pin, a pair of levers extended from the plate, a pair of discs engaged between the plate and the dial for clamping a thread, a follower threadedly engaged on the bolt and having two notches engaged with the levers, a spring biasing the discs together, whereby, the follower is rotatable by the dial when the dial is pushed inwards of the knob.

3 Claims, 7 Drawing Sheets

THREAD TENSION DEVICE FOR A SEWING MACHINE

BACKGROUND OF THE INVENTION (a) Field of the Invention

The present invention relates to a tension device, and more particularly to a thread tension device for a sewing machine.

(b) Description of the Prior Art

A typical thread tension device which is commercially available at present is shown in FIG. 7 and comprises a bolt 90 having one end rotatably engaged in the front portion of a sewing machine 91 and having a knob 92 fixed on the other end by a bolt 93, the knob 92 includes a plurality of teeth 94 formed longitudinally therein, a follower 95 is threadedly engaged on the bolt 90 and includes a plurality of teeth formed on the outer peripheral portion thereof for engagement with the teeth 94 of the knob 92 such that the follower 95 can be rotated by the knob 92 and such that the follower 95 can be caused to move longitudinally along the bolt 90, a pair of discs 96 are engaged on the bolt 90 for clamping a thread 97, a spring 98 is biased between the follower 95 and the discs 96 for biasing the discs 96 together in order to clamp the thread 97, the follower 95 can be caused to force or to release the spring 98 when the knob 92 is rotated such that the resilient force of the spring 98 applied to the discs 96 can be adjusted and such that the thread tension can be adjusted.

However, in order to prevent the spring 98 from being over-pressed, an annular groove 921 is formed in the knob 92, a pin element 99 is extended outward from the sewing machine 91 and has a free end engaged in the annular groove 921, and a stop 922 is formed in the annular groove 921 for engagement with the pin element 99 such that the knob 92 is limited to rotate for one turn only, this arises one problem. Before the suitable thread tension is regulated, the manufacturers and the users have to use try and error method to rotate the knob 92 and the follower 95 in order to adjust the thread tension, if the thread tension is not acceptable, the bolt 93 and the knob 92 should be removed in order to rotate the disc 95 for over one turn and should be assembled in place again. This is inconvenient.

The present invention has arisen to mitigate and/or obviate the afore-described disadvantages of the conventional thread tension devices.

SUMMARY OF THE INVENTION

The primary objective of the present invention is to provide a thread tension device in which the thread tension can be adjusted easily.

In accordance with one aspect of the present invention, there is provided a thread tension device for a sewing machine comprising a plate engaged on the sewing machine, a bolt including a first end rotatably engaged in the plate and a second end extended outward of the sewing machine, a stop formed on the plate and extended inwards of the sewing machine, a limiting means engaged on the first end of the bolt for engagement with the stop in order to limit the bolt to rotate for one turn, a pin engaged on the plate and extended outwards of the sewing machine, a knob fixed on the second end of the bolt, a dial rotatably engaged on the bolt and including at least one hole formed therein for engagement with the pin of the plate and including at least one lever extended away from the plate, a pair of discs engaged between the plate and the dial and engaged on the bolt for clamping a thread, a follower threaded engaged on the bolt and including at least one notch formed therein for engagement with the lever of the dial such that the follower is prevented from rotating relative to the dial and is guided to move longitudinally along the lever, and biasing means biased between the dial and the follower for biasing the discs together, whereby, the follower is caused to rotate relative to the bolt for more than one turn when the dial is pushed inwards of the knob against the biasing means and when the pin is disengaged from the hole of the dial.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
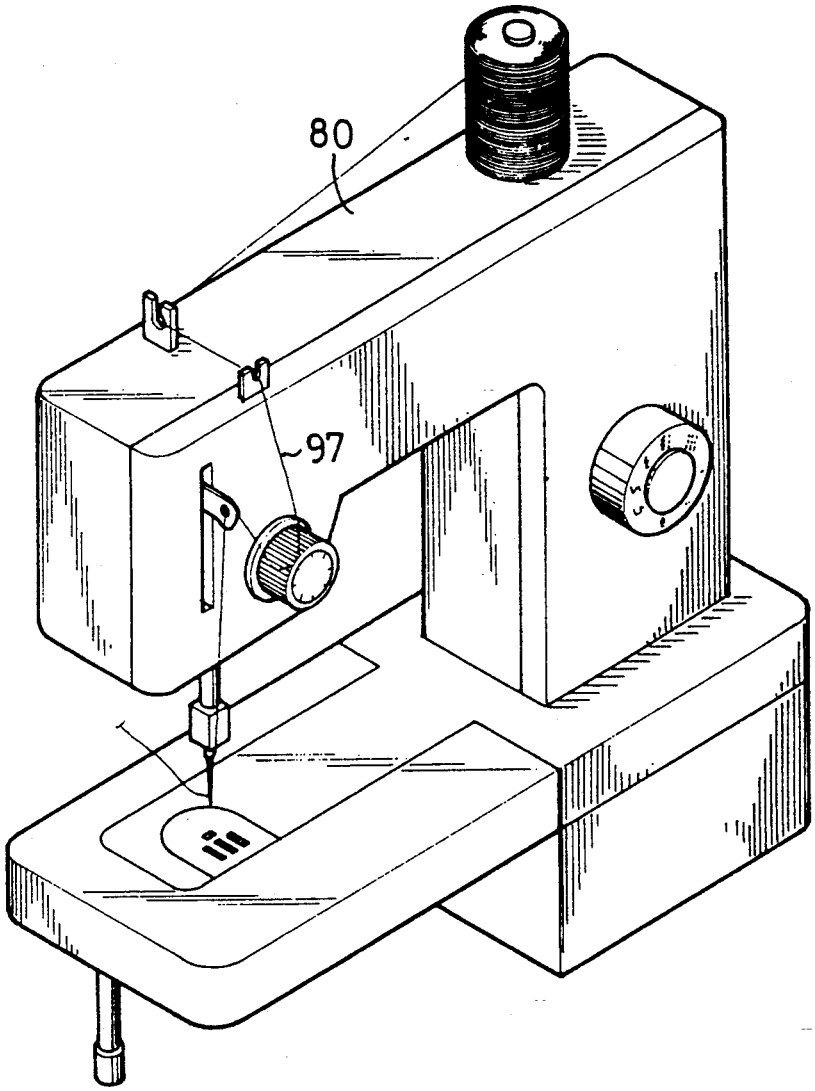
FIG. 1 is a perspective view of a sewing machine; in accordance with the present invention.

Referring to the drawings and initially to FIG. 1, a thread tension device in accordance with the present invention is disposed in the arm 80 of the typical sewing machine for adjusting the thread tension of the thread 97.

Figure 2:
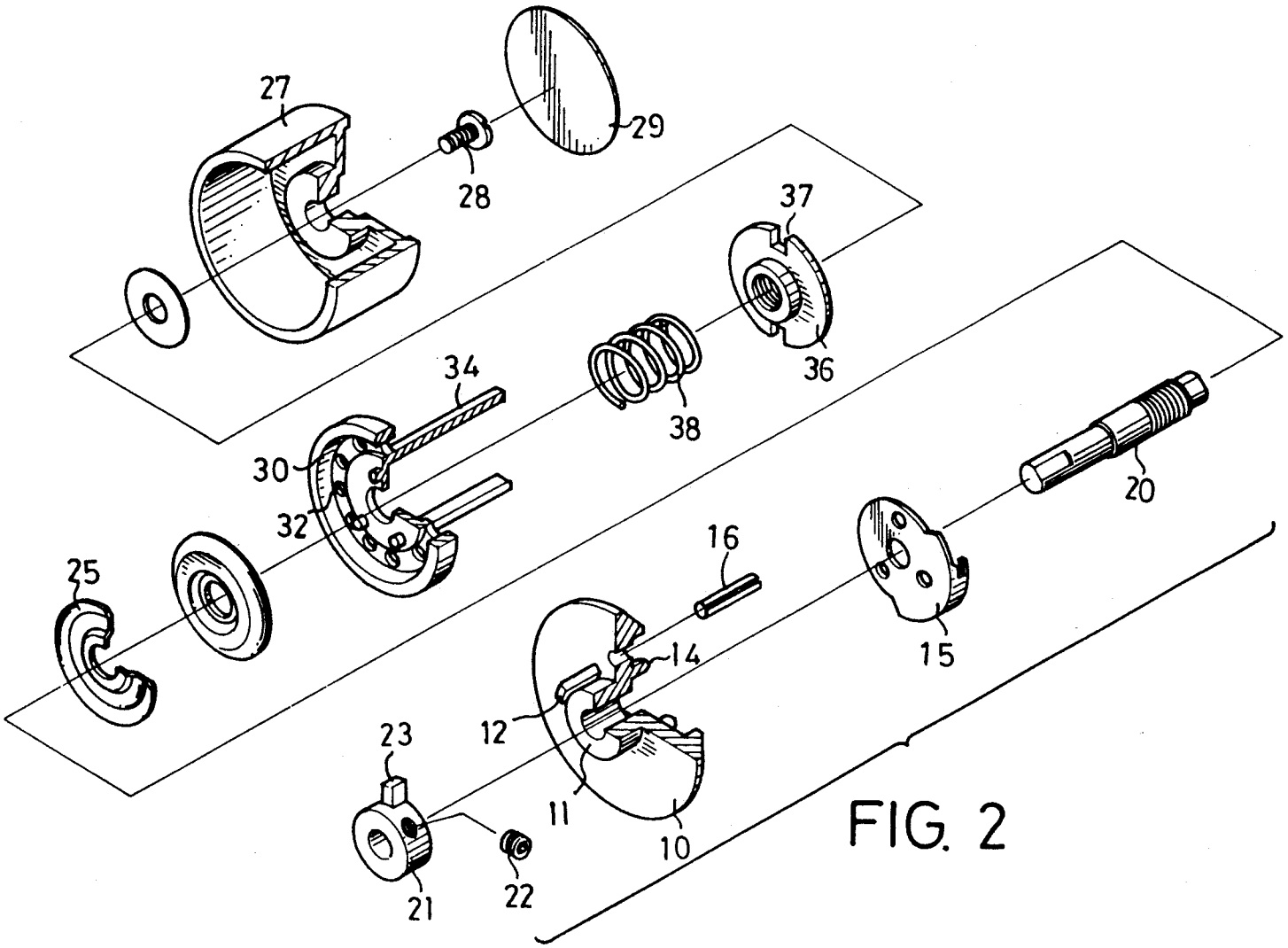
FIG. 2 is an exploded view of a thread tension device in accordance with the present invention.
Figure 3:
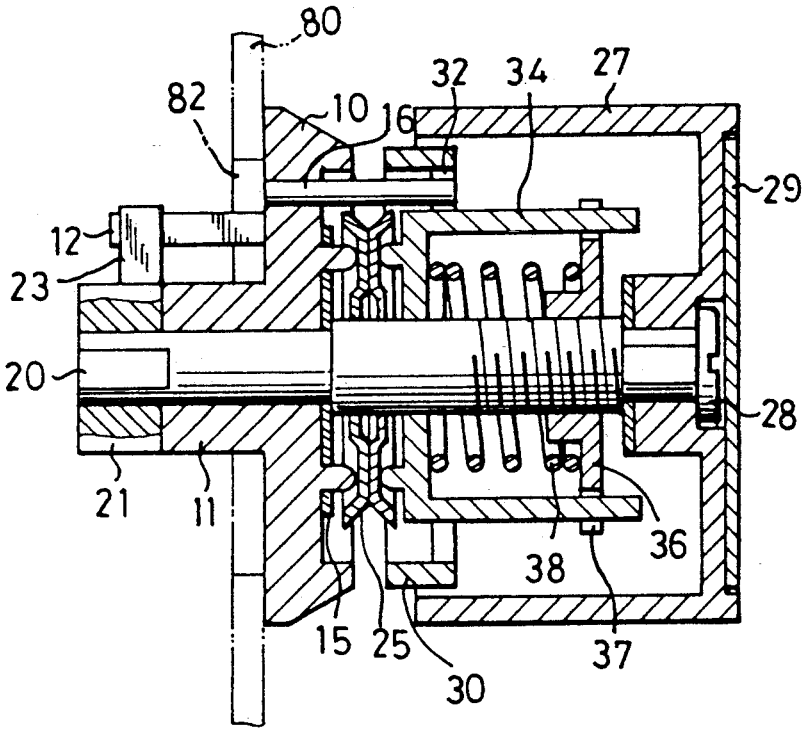
FIGS. 3, 4, 5 and 6 are cross sectional views illustrating the operations of the thread tension device.

Referring next to FIGS. 2 and 3, the thread tension device comprises generally a circular plate 10 fixed on the sewing machine 80 by such as adhesive materials or by welding processes, and including a hub 11 extended through an opening 82 of the sewing machine 80 and extended into the sewing machine 80, a stop 12 extended from the plate 10 and located beside the hub 11, three protrusions 14 extended from the plate 10 opposite to the hub 11 for engagement with a hook 15, the hook 15 is provided for holding a thread and is not related to the present invention and will not be described in further details, and a pin 16 is engaged on the plate 10 and extended in parallel to the protrusions 14.

A bolt 20 includes one end rotatably engaged in the hub 11 of the plate 10 and extended outward beyond the hub 11 for engagement in a ring 21 and fixed in place by a screw 22, the ring 21 includes a projection 23 extended outward therefrom for engagement with the stop 12 of the plate 10 so that the bolt 20 is limited to rotate for one turn only. A pair of discs 25 are engaged on the bolt 20, a knob 27 is fixed to the other end of the bolt 20 by a bolt 28 and has a decorative member 29 fixed on the outer portion thereof for shielding the bolt 28.

A dial 30 is rotatably engaged on the bolt 20 and contacts one of the discs 25 and includes a plurality of holes 32 formed therein for engagement with the pin 16 such that the dial 30 can be prevented from rotating movement, and includes a pair of levers 34 extended away from the discs 25. A follower 36 is threadedly engaged on the bolt 20 and includes a pair of notches 37 oppositely formed in the peripheral portion thereof for engagement with the levers 34 of the dial 30 such that the follower 36 is prevented from rotating relative to the dial 30 and is guided to move longitudinally along the levers 34 when the follower 36 rotates relative to the bolt 20. A spring 38 is biased between the dial 30 and the follower 36 for biasing the discs 25 together.

Figure 4:
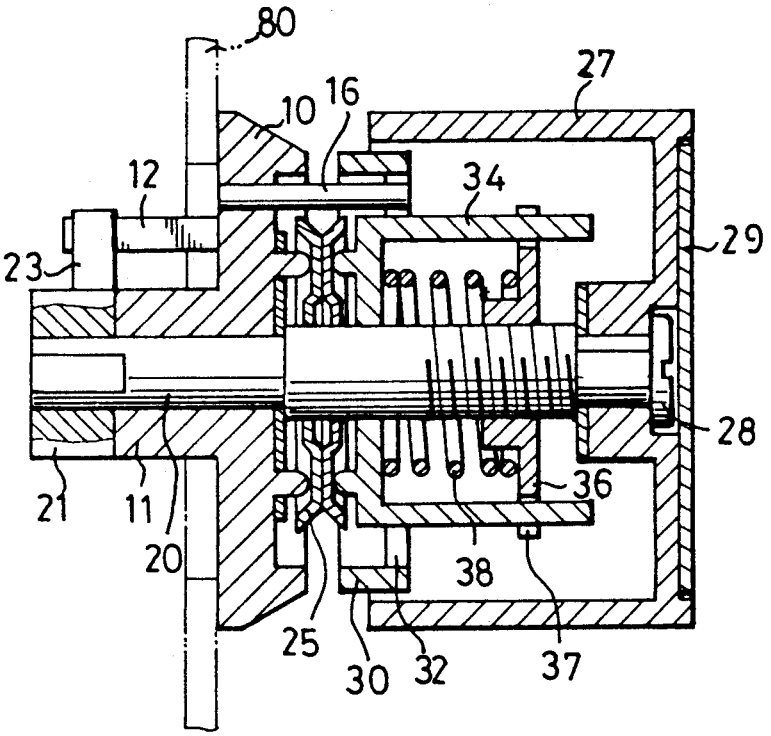

In operation, referring again to FIG. 3, the follower 36 is caused to rotate relative to the bolt 20 when the bolt 20 is rotated by the knob 27, and the follower 36 is limited to move longitudinally along the levers 34 by engagement between the levers 34 and the notches 37 such that the spring 38 can either be compressed or released by the follower 36, for example, as shown in FIG. 4, when the follower 36 moves toward the spring 38, the spring 38 is further compressed by the follower 36 such that the discs 25 are further biased together and such that the tension of the thread clamped between the discs 25 is increased. On the contrary, when the follower 36 moves away from the spring 38, the thread tension is decreased.

Figure 5:
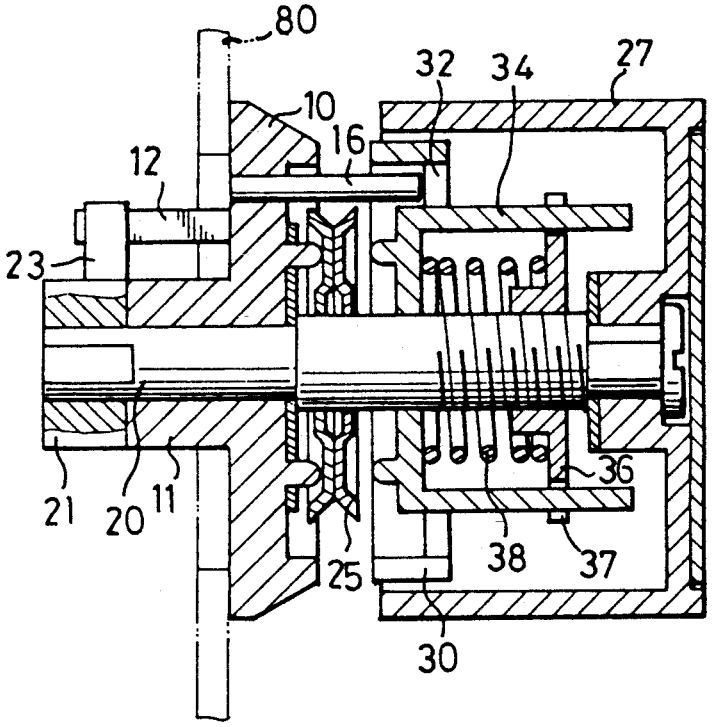
Figure 6:
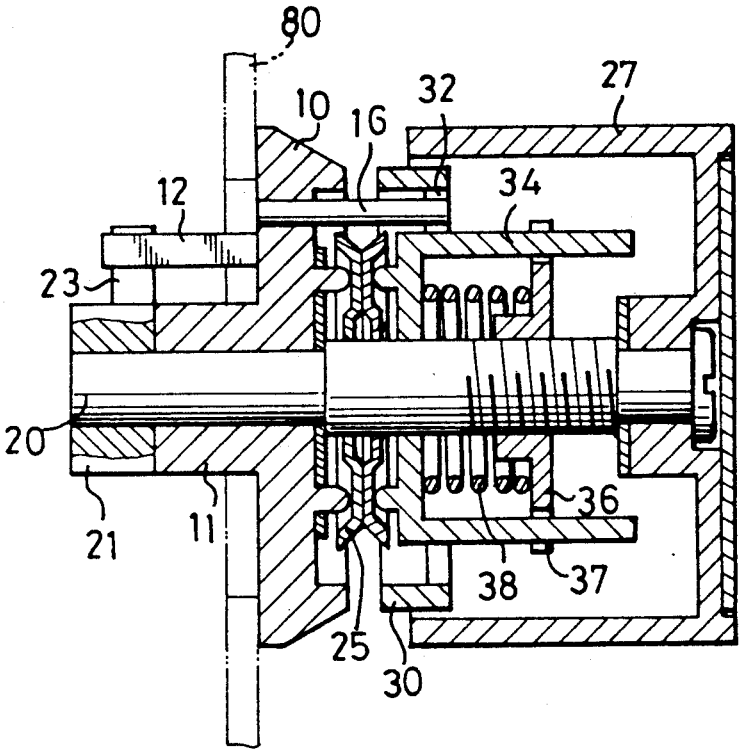
Figure 7:
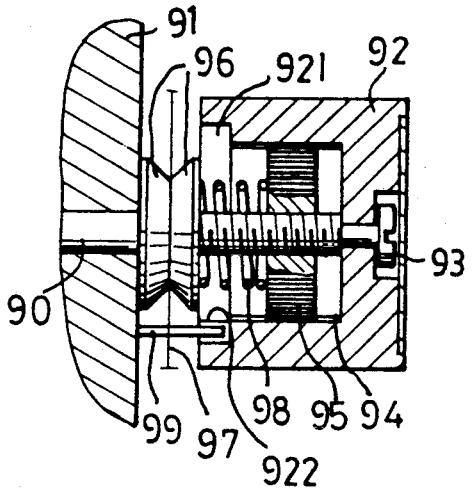
FIG. 7 PRIOR ART
FIG. 7 is a cross sectional illustrating a typical thread tension device.

When the follower 36 is required to rotate more than one turn relative to the bolt 20, referring next to FIG. 5, the dial 30 is pushed inwards of the knob 27 against the spring 38 by a driving tool, such as a screw driver or a hook element (not shown), and is rotated such that the follower 36 is caused to rotate relative to the bolt 20, whereby, the follower 36 can be caused to move either toward or away from the dial 30 such that the spring 38 can either be further compressed or be released. The pin 16 is engaged in one of the holes 32 again when the dial 30 is released, as shown in FIG. 6, in this drawing figure, the follower 36 moves further towards the dial 30 such that the spring 38 is further compressed and such that the thread tension is increased.

Accordingly, the follower of the thread tension device in accordance with the present invention can be easily rotated for more than one turn relative to the bolt.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A thread tension device for a sewing machine comprising a plate engaged on said sewing machine, a bolt including a first end rotatably engaged in said plate and a second end extended outward of said sewing machine, a stop formed on said plate and extended inwards of said sewing machine, a limiting means engaged on said first end of said bolt for engagement with said stop in order to limit said bolt to rotate for one turn, a pin engaged on said plate and extended outwards of said sewing machine, a knob fixed on said second end of said bolt, a dial rotatably engaged on said bolt and including at least one hole formed therein for engagement with said pin of said plate and including at least one lever extended away from said plate, a pair of discs engaged between said plate and said dial and engaged on said bolt for clamping a thread, a follower threadedly engaged on said bolt and including at least one notch formed therein for engagement with said lever of said dial such that said follower is prevented from rotating relative to said dial and is guided to move longitudinally along said lever, and biasing means biased between said dial and said follower for biasing said discs together, whereby, said follower is rotatable by said dial when said dial is pushed inwards of said knob and when said pin is disengaged from said hole of said dial.

2. A thread tension device according to claim 1, wherein said limiting means includes a ring fixed on said first end of said bolt and a projection extended outwards from said ring for engagement with said stop of said plate.

3. A thread tension device according to claim 1, wherein said plate includes a hub formed therein for rotatably supporting said first end of said bolt.

* * * * *